US005732495A

United States Patent [19]

Lowe et al.

[11] Patent Number: 5,732,495

[45] Date of Patent: Mar. 31, 1998

[54] TWIST TIE ARTICLE

[75] Inventors: Gary L. Lowe; Terry L. Langland, both of Worthington, Minn.

[73] Assignee: Bedford Industries, Inc., Worthington, Minn.

[21] Appl. No.: 659,146

[22] Filed: Jun. 5, 1996

[51] Int. Cl.[6] ..... G09F 3/14

[52] U.S. Cl. ..... 40/665; 40/637; 40/638; 24/30.5 T

[58] Field of Search ..... 40/665, 630, 637, 40/638, 316; 24/27, 30.5 T; 283/81

[56] References Cited

U.S. PATENT DOCUMENTS

| | | | |
|---|---|---|---|
| 1,156,489 | 10/1915 | MacIntosh | 24/27 X |
| 1,164,450 | 12/1915 | Bates | 24/27 X |
| 1,348,546 | 8/1920 | Cutler . | |
| 2,362,092 | 11/1944 | Phelps . | |
| 2,973,597 | 3/1961 | Powell . | |
| 3,290,854 | 12/1966 | MacMurray . | |
| 3,370,328 | 2/1968 | Hilton . | |
| 3,409,948 | 11/1968 | Goodwin . | |
| 3,426,393 | 2/1969 | Mead . | |
| 3,548,906 | 12/1970 | Murphy | 24/30.5 T X |
| 4,407,082 | 10/1983 | Stehouwer . | |
| 4,656,767 | 4/1987 | Tarrant | 40/316 |
| 4,856,214 | 8/1989 | Machen | 40/316 |
| 4,948,202 | 8/1990 | Helseth . | |

*Primary Examiner*—Brian K. Green

*Attorney, Agent, or Firm*—R. C. Baker & Associates, Ltd.

[57] ABSTRACT

The twist tie article permits simultaneous banding and tagging of merchandise and has a twist tie for banding about merchandise and a tag comprised of an information portion for displaying printed matter and an attachment portion for attaching the tag to itself after encircling the tag about a section of the twist tie. The tag is formed of water resistant sheet material folded along the boundary between the information and attachment portions with the portions extending from the fold in an approximately parallel orientation. The attachment portion is bonded to the information portion, with the twist tie situated between the information and attachment portions and between the fold and the bond. The tag is thereby securely and reliably attached about the twist tie without need for relying upon the formation of a bond between the tag and the twist tie.

14 Claims, 2 Drawing Sheets

TWIST TIE ARTICLE

BACKGROUND OF THE INVENTION

This invention relates generally to articles for simultaneously banding and tagging merchandise, and more particularly to a twist tie article having a tag for bearing printed matter securely attached about a twist tie for banding merchandise.

Merchandise of many different types is banded in one way or another for packaging or preparing the merchandise for movement in channels toward the ultimate presentation and marketing to the consumer. For example, a twist tie may be placed about the mouth of a bag or about a box of merchandise or about multiple boxes. The twist tie may also be placed directly about the merchandise itself, such as about a grouping of agricultural produce or about a single item of merchandise (e.g., a rolled or folded newspaper).

Labeling or marking of merchandise with printed matter is also often desirable to provide information to various entities in the production and marketing channels as well as to the ultimate consumer. The printed matter may provide information regarding merchandise identification and price and may take the form of, for example, machine readable or scannable material (such as codes comprised of bars or characters) and human readable material (such as characters and graphical or pictorial matter).

In modern mass merchandising outlets such as superstores or supermarkets, there has been an almost complete movement toward labeling products (or the packaging thereof) with an identification code, such as a Universal Product Code (UPC), which includes a bar code readable by an electronic scanner.

Additionally, other printed matter (besides the UPC bar code) may also be associated with the produce items. For example, in the particular case of agricultural produce, a "Product LookUp" (PLU) number identification code, a trademark of the producer and a collective or certification mark may also be displayed. Inclusion of storage directions, serving suggestions and recipes for preparing the particular produce item may promote sales of the produce, and a table of "Nutritional Facts" and an indication of the place of origin (e.g., country or state) may be required by law to be marked on the produce.

However, banding and tagging merchandise in a quick, efficient, simple and (most importantly) secure and reliable manner has been an elusive goal. Banding and tagging difficulties have been most serious in the production and marketing of agricultural produce, where problems can arise both during and after the banding and tagging operation is performed.

It has been found that one of the most efficient environments for banding and tagging produce is in the agricultural field relatively soon after the produce is harvested (but usually prior to any significant processing of the produce).

The task of banding and tagging the produce in the agricultural field typically falls upon agricultural field workers. A field worker may have to perform this task hundreds of times each day, and they are typically paid on the basis of their total daily output (and not on the basis of the time spent performing these tasks). As a result, the field workers strongly favor techniques of banding and tagging articles that are supremely quick and simple to apply to produce (and they may resist or refuse techniques that require excessive time or effort). They realize that reliable twist tie banding can be accomplished by an approximately 180 degree turn of the wrist, provided the twist tie is formed of layers lacking distortion recovery memory (e.g., paper laminates or those with paper and some plastic). They also realize that twist ties formed using all plastic laminates, while readily reusable, generally exhibit sufficient distortion recovery memory to require more hand motions beyond a simple 180 degree turn to give reliable banding.

Bands and tags applied in the agricultural field, however, are subjected to the rigors of a variety of produce processing operations, and must remain intact and securely in place on the produce throughout the processing and sales display and scanning at the supermarket checkout counter. Produce processing often includes washing the produce (e.g., with a high velocity water blast), chilling the produce by dumping ice thereon and/or submersion of the produce in chilled water, and moving the produce about (e.g., by conveyors). Once the produce reaches the supermarket display case, it is unpacked and then often subjected to repeated sprayings with water.

Tags that succumb to the produce processing operations by becoming detached from the twist tie or by appearing excessively worn or tattered or fatty are likely to cause rejection of the produce by the grocer and the consumer. Produce buying is generally considered to be highly dependant upon the presentation of a pleasing product appearance to the consumer, and if the condition of a tag on produce appears unattractive, a consumer is generally believed to be less inclined to buy the produce. As a result, grocers may be less inclined to purchase and display produce with a tag having an unsightly appearance. In a more practical sense, the tag must remain attached to the produce and readable by a checkout scanner until the time of supermarket checkout, and grocers may refuse produce shipments having a significant number of tags missing or in an unscannable condition.

To simplify and quicken the banding and tagging of merchandise such as produce, attempts have been made at producing an article incorporating a tag and a twist tie so as to permit simultaneous or one step banding and tagging of merchandise, but these attempts in the past have suffered from disadvantages.

Problems arise out of the significant difference between the preferred materials used for the tag component and for the tie component. The tag component is preferably highly durable and resistent to damage, and is preferably formed from a flexible (but not elastomeric) and strongly tear resistant material to preserve its appearance and scanability throughout the various produce processing operations. A plastic material is highly desireable for forming the tag. In contrast, permanent deformation and even tearing of the sheet material of the twist tie layers during twisting of one section of the tie with another section of the tie can be highly desirable to produce a secure intertwining such that banding of the merchandise is effected using only a quick single twist of the tie ends (e.g., a single 180 degree rotation of the wrist of the worker's hand). A paper material is most desirable for the tie.

Difficulties can arise from trying to adhere a separate panel of plastic sheet material to one face of a paper twist tie. Even if a relatively strong and durable bond is initially achieved between the plastic tag and the paper layers of the twist tie, the paper layers are the weakest part of the twist tie and are extremely vulnerable to tearing or delaminating from each other during the rigorous produce processing. These weaknesses can permit the tag to separate from the wire (the stronger part of the twist tie) banded about the produce, and ultimately can result in the loss of the tag from the produce.

A tag comprised of a lamination of two separate tag panels of sheet material with the twist tie sandwiched therebetween has also been used, but has generally only added extra material expense while not providing a reliable and attractive product. The difficulty in securely adhering a relatively large panel of sheet material to a narrow paper twist tie face is not avoided, and separation of the twist tie and sheet panels from each other can allow the parts to separate from the wire of the twist tie. Also, any separation or wrinkling or puckering of the large adhered panels with respect to each other (e.g., as a result of temperature changes) can give the tag an undesirably ragged or ratty appearance in the supermarket display case.

Articles with the twist tie and the tag formed from the same continuous piece of sheet material have also been used. While such a design reduces the likelihood that the tag portion of the sheet material will become separated from the twist tie portion of the sheet material, it achieves such a result with more expense than the market will readily accept because of the significant amount of sheet material that often must be cut away as waste to form the distinct tag and tie shapes during manufacture. Furthermore, delamination of the economical layers (e.g., paper) of the sheet material can cause tag loss or unsightly appearance.

Additionally, twist tie and tag portions formed from the same sheet material force the sheet material of the tag portion to have the same characteristics as the sheet material of the twist tie. Thus, the sheet material forming the article must necessarily be a compromise between the optimal material for the function of the tag (e.g., plastic) and the optimal material for the function of the twist tie (e.g., paper), and thus the overall performance of articles formed in this manner is compromised.

There is therefore a need for an economical tag-bearing tie article for banding and tagging merchandise that is both easily and quickly applied to merchandise and is durable enough to remain intact and securely attached to merchandise and is not smeared or defaced at its tag portion during its movement through production and marketing channels.

SUMMARY OF THE INVENTION

The invention provides a twist tie article that permits simultaneous banding and tagging of merchandise. The article comprises an elongate twist tie for banding about merchandise and the twist tie has a deadfold wire embedded between opposing ribbon layers laminated together. The article further comprises a tag having an information portion for displaying printed matter thereon and an attachment portion for attaching the tag to itself after the tag is encircled about a section of the twist tie. The tag comprises a single continuous panel of water resistant sheet material discrete from the twist tie and folded along the boundary between the information and attachment portions. The portions of the tag extend from the fold in an approximately parallel orientation. The extent of the information portion away from the fold is greater than the extent of the attachment portion away from the fold such that at least a part of both surfaces of the sheet material of the information portion is viewable for displaying printed matter thereon. The twist tie has a section thereof situated between the information and attachment portions proximate to the fold. The information and attachment portions are directly bonded to each other with the twist tie being situated between the fold and the bond joining the portions. The sheet material of the tag is wrapped entirely about the twist tie to directly bond to itself to provide a secure and reliable attachment of the tag about the twist tie without need for relying upon a bond between the tag and the twist tie.

Preferably, the sheet material of the tag differs from the material forming at least one layer of the twist tie. The sheet material of said tag is most preferably tear resistant, and ideally comprises a plastic. Most preferably, the opposing layers lack distortion memory such that securing a band of the twist tie about merchandise is reliably accomplished by twisting a section of the twist tie with another section of the twist tie using only an 180 degree hand rotation motion applied to the sections of the twist tie. Ideally, at least one layer of the twist tie comprises a material easily torn upon twisting a section of the twist tie with another section of the twist tie. Most ideally, the easily torn material of the twist tie comprises a paper material.

In the most preferred embodiment, the furthest extent of the information portion from the fold is more than about twice the furthest extent of the attachment portion from the fold.

The information portion preferably includes printed matter comprising a scannable merchandise marking and the printed matter is water resistant.

Still other features and benefits of the invention will be evident as this description proceeds.

DESCRIPTION OF THE PREFERRED EMBODIMENT

Figure 1:
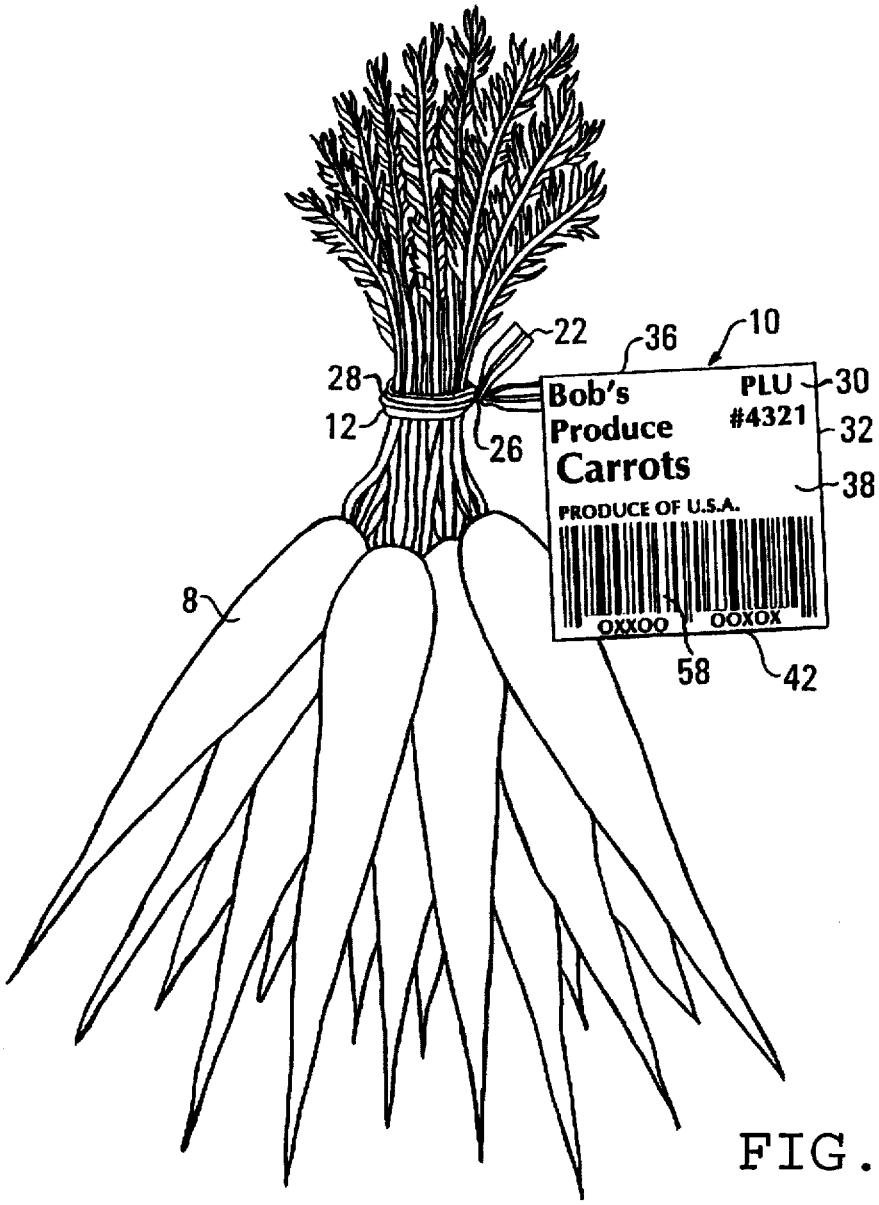
FIG. 1 is a schematic front view of the new twist tie article with the twist tie thereof in a banded condition about a clump of vegetables, namely carrots, and particularly illustrates marking information on the information portion of the tag of the twist tie article.

The twist tie article 10 of the invention (see FIG. 1) is generally comprised of a twist tie 12 component and an informational tag 30 component encircling a section of the twist tie. The twist tie article 10 permits simultaneous banding and tagging of merchandise such as agricultural produce including, for example, a clump of carrots 8.

The twist tie 12 of the twist tie article 10 is employed for banding about merchandise to effect a releasable fastening or affixing of the tag 30 to the merchandise. In many applications the twist tie 12 also functions to bundle or bind together more than one item of merchandise into a grouping (such as, for example, a clump of agricultural produce) simultaneous with the aforementioned fastening of the tag 30 to the merchandise.

The twist tie 12 is preferably an elongate relatively flat strip (see FIGS. 2 and 4) having a length that is significantly longer than its transverse width. The twist tie 12 (see FIG. 3) is comprised of deadfold wire 18 between two opposing layers (e.g., a first layer 14 and a second layer 16) laminated together to form a unitary tie strip. Each layer 14, 16 is preferably comprised of an elongate ribbon of sheet material, and the ribbon layers are laminated or united together by bonding the adjacent faces of the ribbon layers together. The bonding is most preferably accomplished by placing adhesive (not shown) between the layers 14, 16 to effect a substantially continuous lamination of the layers. Optionally, other methods of uniting the layers together may be employed, such as, for example, fusion (as by heat). The first layer 14 side of the tie has a first face 15, and similarly the second layer 16 side of the tie has a second face 17.

The deadfold wire 18 is embedded or sandwiched between the bonded adjacent inward faces of the first 14 and second 16 layers of the lamination. It is held between the layers 14, 16 by the bonded regions of the layers located on either lateral side of the longitudinally extending wire 18. In the preferred twist tie 12, the wire 18 is located adjacent to and is in contact with the adhesive bonding the layers 14, 16 together. The deadfold character of the wire 18 means that the wire 18 is relatively ductile and easily distorted or twisted and is not springy or resilient or biased to return to the shape it had prior to the application of a bending force. Thus, a force applied to a unitary twist tie (e.g., to the faces 15, 17 having a deadfold wire therein) causes a relatively easy bending of the ideal tie into an altered shape that is substantially retained or maintained until another bending force is applied to further alter its shape. Ideal twist ties are thus easily bent into a shape for surrounding or circumscribing or banding merchandise, and also sections of the tie are readily twisted together.

Banding the twist tie 12 about merchandise generally comprises bending or wrapping the length of the tie about the outer perimeter or bounds of an item of merchandise or a grouping or clump of more than one item of merchandise (see FIG. 1). Sections of the twist tie converge and cross each other at one point of the perimeter of the merchandise, and the free sections of the tie (i.e., the tie sections extending beyond the point of crossing) are grasped or pinched by the fingers of the person applying the tie. The person rotates his or her wrist on the axis of the forearm so that the free sections of the tie are twisted into a configuration approximating an intertwined spiral or double helix relationship that functions to hook or interlock the tie sections together. The intertwined condition of the twisted sections 26 of the tie resists expansion of the band formed by the twist tie (see FIG. 1) for as long as the intertwined condition is maintained. The tie section 28 that circumscribes the merchandise (i.e., the banding section 28 of the tie) generally applies a radially inward force to the merchandise that keeps the tie in place and can bind multiple items together.

The most highly preferred twist tie 12 of the invention is one that may be twisted into a secure and reliable intertwined condition using only a single twist of a person's hand grasping the twist tie sections. (A single hand twist as used herein comprises an approximately 180 degree rotation of a person's hand and wrist about the longitudinal axis of the person's forearm.) This characteristic permits a quick and easy banding of merchandise with the twist tie 12.

The particular character of the sheet material forming the laminated layers 14, 16 of the tie is important for enhancing the capability of the twist tie to be twisted into a secure intertwined condition using only a single hand twist.

A characteristic of the sheet material (forming the laminated layers 14, 16) that influences the ability of the twist tie to be formed into a secure intertwined condition with a single hand twist is the ease with which the sheet material is distorted or crumpled (or even crushed or torn) as sections of the tie are twisted with each other into an intertwined condition. Ties having ribbon layers formed of an easily deformed or compressed or easily torn sheet material permit the tie sections to be reliably twisted into a stable more tightly twisted or intertwined condition using a single 180 degree hand twist. Ties having layers formed of a stiffer, stronger, more crush or tear resistant sheet material generally require more twist rotation than 180 degrees to achieve reliable, stable intertwined twisted condition.

The significant characteristic affecting the secureness of the intertwined condition is the sheet material's lack of a significant distortion memory. Distortion memory in a material provides it with the tendency to exhibit some recovery back to its former (undeformed) shape after the deforming force (e.g., the twisting force applied by a hand) has been removed. A twist tie having ribbon layers formed from sheet materials with relatively low distortion memory do not seek to recover their former shape by moving and are thus more likely to stay in the intertwined condition.

In the twist tie article of the invention, the desired secure single hand twist banding characteristic is achieved by employing twist tie ribbon layers that lack significant distortion memory. Illustratively, paper sheet material exhibits this desired characteristic. (As used herein, paper has the standard dictionary meaning, namely a felted or matted sheet of any of a variety of cellulosic fibers, including but not limited to fibers from wood, cotton, rice, and a host of other sources.) Paper, and especially paper in the very thin thicknesses preferably employed for the layers 14, 16 of the twist tie, has the characteristic of being easily distorted and crushed and torn by the action of twisting one section of the tie with another section of the tie. The distortion in the paper ribbon layers 14, 16 of the tie sections permit a relatively tight and snug intertwined condition to be formed by the twisted tie sections. Further, the paper material has no significant distortion memory. It does not exert much force to restore or recover its pre-deformation shape, and does not seek to dislodge the intertwined condition. Overall, a more secure locking relationship results that resists slippage of the twisted tie sections 26 out of the intertwined condition.

These characteristics of the preferred paper layers permit the twist tie 12 of the article 10 to more consistently form a secure and reliable banding of merchandise with a single approximately 180 degree rotation of the hand (or more than a 180 degree rotation up to an approximately 220 degree single rotation of the hand), and also remain in a banded condition about merchandise despite rough treatment to which the merchandise and the twist tie article may be subjected. Ideally, the twist tie is removable only by the deliberate untwisting of the tie by, for example, the hand of the consumer.

The informational tag 30 of the invention features a special attachment structure that avoids the need to create a secure and reliable bond directly between the relatively flat sheet material of a tag and the face or faces of a twist tie in order to securely connect the tag to the twist tie. Instead, the tag 30 is wrapped about a section of the twist tie 12 and is directly bonded to itself to form an encirclement by the tag about the twist tie.

The tag 30 is formed from a continuous panel of sheet material (see FIG. 4) that is discrete and separate from (i.e., not a continuous part of) the sheet material of the laminated ribbons 14, 16 of the twist tie 12.

The sheet material of the tag 30 is folded or turned over upon itself along a fold 36 (see FIGS. 3 and 4) that defines a line or boundary between an information portion 32 of the tag and an attachment portion 34 of the tag. The information 32 and attachment 34 portions of the folded sheet material extend away from the fold 36 in an approximately parallel orientation. The information 32 and attachment 34 portions extend in substantially the same direction and are for the most part located adjacent to each other. (For illustrative purposes, the twist tie article 10 will be described with the ridge of the fold 36 oriented as the uppermost part (or top) of the tag 30 with the information portion 32 being forward of the attachment portion 34, although this convention is primarily for the purposes of illustration and should not be interpreted to limit or require a particular orientation or location of the twist tie article on merchandise.)

The sheet material forming the information portion 32 has opposite surfaces that are hereinafter referred to as a front surface 38 and a rear surface 40. The information portion 32 terminates at a free edge 42 at the furthest extent from the fold 36 (e.g., the lowermost extent or bottom of the information portion). The free edge 42 is most preferably substantially parallel to the line of the fold 36.

The sheet material forming the attachment portion 34 also has opposite surfaces, with the rearward attachment portion surface being an exposed or outer surface 44 and the forward attachment portion surface being a hidden or inner surface 46 that faces the rear surface 40 of the information portion 32. (The outer surface 44 is on the same side of the sheet material of the tag 30 (prior to folding) as the front surface 38 of the information portion 32 and, similarly, the inner surface 46 is on the same side of the sheet material (prior to folding) as the rear surface 40 of the information portion.) A transverse edge 48 terminates the lowermost extent of the attachment portion 34, and is preferably substantially straight and parallel to the direction of the fold 36.

The extent of the information portion 32 away from the fold 36 (in a direction perpendicular to the fold) is significantly greater than the extent of the attachment portion 34 away from the fold (also in a direction perpendicular to the fold). Usually, the (vertical) length dimension of the information portion (e.g., the distance between the fold 36 and the free edge 42) will be more than two or three times greater than the (vertical) length dimension of the attachment portion (e.g., the distance from the fold 36 to the transverse edge 48). This relationship between the information 32 and attachment 34 portion permits at least a part of both the front 38 and the rear 40 surfaces of the information portion to bear printed matter that is viewable and not obstructed by the attachment portion. Preferably, only a relatively small part of the rear surface 40 of the information portion 32 is blocked or obstructed from view by the overlapping attachment portion 34 so that a relatively large proportion (e.g., at least about half) of the rear surface 40 may bear visible printed matter thereon. In the preferred embodiment, the extent (or vertical length) of the information portion 32 is preferably more than about twice the extent (or vertical length) of the attachment portion 34. Most preferably, the length of the information portion 32 is more than about four times greater than the length of the attachment portion, and may be about 6 or 7 or even more times greater in length.

Figure 2:
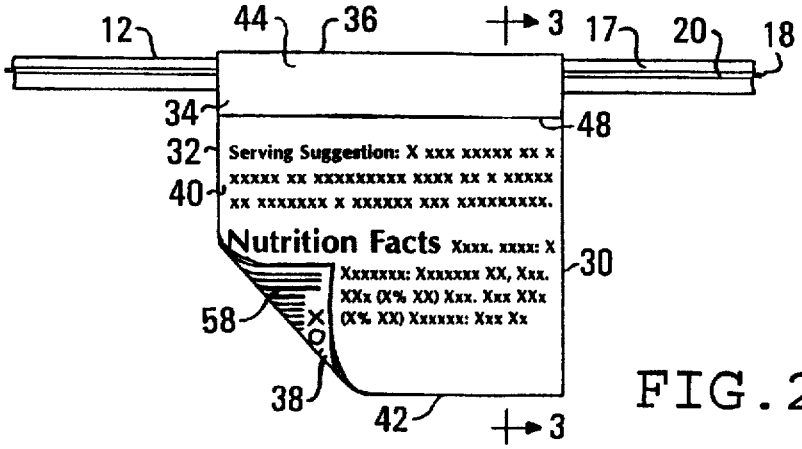
FIG. 2 is a schematic rear view of the twist tie article (with sections of the twist tie broken away) and having a corner of the tag partially bent over to particularly illustrate the marking information visible on both the front and rear surfaces of the information portion of the tag.

The front 38 and rear 40 surfaces of the information portion 32 of the tag 30 can have a multitude of informational markings on it. For agricultural produce, it should include a scannable product code or identification. This normally will be in the nature of a UPC marking 58 and will include matter for the price of the product as well as product identification per se. Bar codes are the most popular and are fully effective to provide scannable product identification matter. Other information markings are illustrated in FIGS. 1 and 2 and include product look-up (PLU) numbers, a trademark identification, serving suggestions, and nutrition facts. A variety of other markings perceived to enhance sales may be employed, not least of which may be storage suggestions or an identification of the country of origin for the produce. Also, the outer surface 44 of the attachment portion 34 may have information or even decorative markings or graphics printed thereon.

The tag 30 is securely and reliably connected to the twist tie 12 without requiring the tag to be securely bonded directly to the twist tie. The parts of the information 32 and attachment 34 portions located adjacent to the fold 36 form an open-ended pocket or collapsed tube or flattened sleeve structure 52 that entirely and completely encircles or loops or wraps about a section of the twist tie. The tag 30 is attached or bonded to itself to produce a connection of the tag 30 to the twist tie 12 in a secure and reliable manner.

Figure 3:
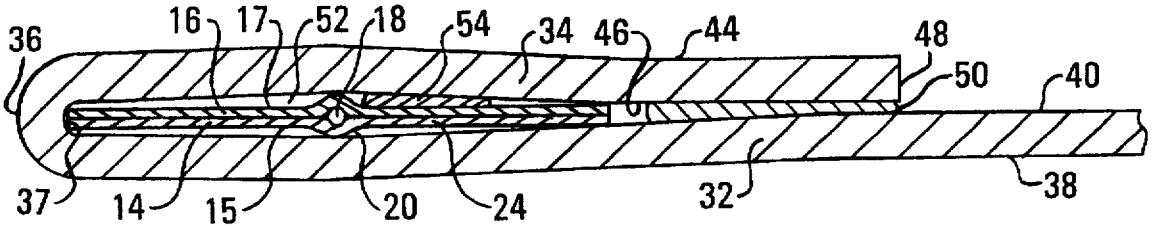
FIG. 3 is a schematic sectional view of the twist tie article (with a portion of the tag broken away) taken along line 3—3 of FIG. 2 and particularly illustrating the encirclement of the tag about the twist tie and the direct bonding of the tag to itself.
Figure 4:
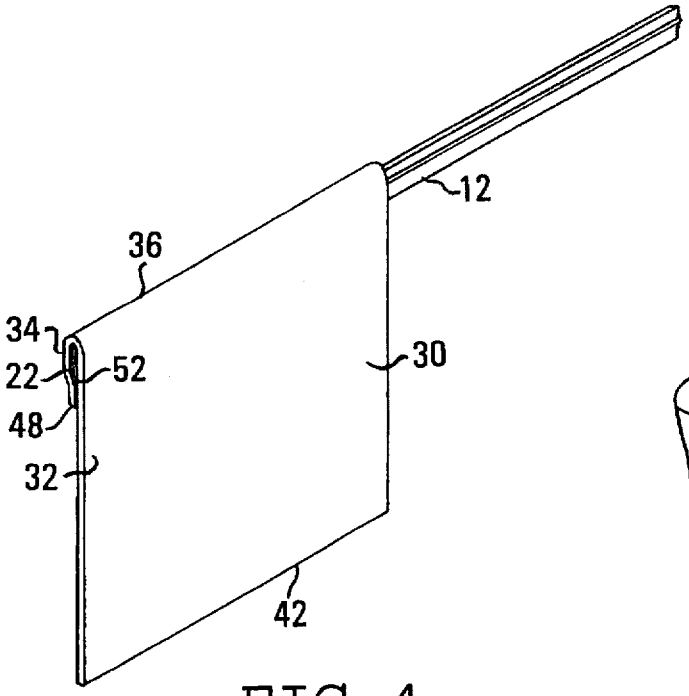
FIG. 4 is a schematic perspective view of an embodiment of the new twist tie article in which the section of the twist tie situated between the information and attachment portions of the tag includes an end section of the tie.

After the fold 36 has been formed in the sheet material of the tag 30, a section of the twist tie 12 (such as, for example, a relatively central section or an end section) is positioned or situated proximate to the interior side or crotch 37 of the fold 36 between the rear surface 40 of the information portion 32 and the inner surface 46 of the attachment portion 34 (see FIG. 3). The twist tie 12 is most preferably positioned closely adjacent to the crotch 37, and ideally is in contact with the fold crotch 37.

With a section 24 of the twist tie located adjacent to the crotch 37 of the fold 36 and between the portions 32, 34, the overlapping parts of the tag portions 32, 34 are attached or united together (preferably in a permanent manner) by a bond 50 at a location spaced outwardly or away from the fold 36 and outwardly from the twist tie so that the sheet material of the tag wraps entirely about the twist tie. The attachment portion 34 traps or holds the twist tie against the rear surface 40 of the information portion 32.

The length of the attachment portion 34 (e.g., the distance between the fold 36 and the transverse edge 48) is related in part to the lateral width (i.e., measured perpendicular to the direction of the wire 18) of the twist tie 12 situated between the information 32 and attachment 34 portions. The attachment portion 34 should extend a sufficient distance from the fold 36 to permit the formation of an open-ended flattened sleeve 52 large enough to accommodate the lateral width of the twist tie 12 between the fold 36 and the bond 50 (e.g., a distance at least equal to the lateral tie width) plus an additional amount to provide an area of the inner surface 46 for a secure bond to the rear surface 40 of the information portion 32. Preferably, the length of the attachment portion is greater than the width of the section of the twist tie situated between the portions 32, 34 but does not exceed about three times the width of the encircled section 24 of the twist tie, and usually will not exceed about twice the width of the twist tie.

The inner surface 46 of the attachment portion 34 is preferably bonded along a marginal strip area (near the transverse edge 48) to the adjacent location on the rear surface 40 of the information portion 34. The bond 50 is critically formed directly between the adjacent surfaces 40, 46 of the portions 32, 34, without twist tie material interposed between the bonded surfaces. In other words, no twist tie structure interrupts the continuousness of the bond between the portions 32, 34 (although, for example, an edge of the twist tie may extend into some part of the bond, if desired). The strength and integrity of the bond 50 between the tag portions is therefore not dependent upon the strength and integrity of any other structures such as, for example, the bond between the laminated ribbon layers 14, 16 of the twist tie 12 or any bond between the twist tie and the portions 32, 34 of the tag 30. At least a portion of the bond 50 is spaced from the crotch 37 of the fold 36 a sufficient distance such that the encircled tie section 24 is substantially entirely located between the strip of the bond 50 and the crotch 37 of the fold 36. The bond 50 preferably extends transversely from one side edge of the tag to the other side edge. The width of the marginal strip area occupied by the bond 50 (the width being measured perpendicular to the direction of the fold 36) is preferably relatively small and ideally is less than the lateral width of the encircled section 24 of the twist tie (or at least less than twice the lateral twist tie width).

In the most preferred embodiment of the invention, a supplemental bond 54 is formed between the twist tie 12 and an interior surface of the flattened sleeve 52 of the tag 30 (in addition to the direct bond 50 between the tag portions 32, 34) to enhance resistance against longitudinal movement or slippage of the twist tie through the flattened sleeve (or, conversely, slippage of the tag along the longitudinal extent of the tie). Illustratively, the supplemental bond 54 may be formed between the face 17 of the tie 12 and the inner surface 46 of the attachment portion 34 (see FIG. 3). The secure attachment of the tag to the tie is not dependent upon this supplemental bond 54, and the supplemental bond 54 could be omitted without noticeably weakening the attachment of the tag to itself or to the encirclement of the tie by the tag.

The folding and bonding of the portions 32, 34 forms an open-ended flattened sleeve structure 52 between the information 32 and attachment 34 portions and between the fold 36 and the bond 50 for securely holding the tag on the twist tie without the need for relying upon the formation of a secure bond between the tag and the tie. The sheet material of the tag completely encircles and wraps about the twist tie. As a result, even if the laminated ribbon layers 14, 16 of the tie become delaminated or torn or are otherwise damaged, the tag 30 remains securely wrapped about the deadfold wire 18 that is in a banded condition about the merchandise.

Preferably, bonds are effected by adhesively securing the parts together, although fusion without the addition of adhesive may be employed where the tag material is susceptible to fusion (as by heating).

A variety of known bonding adhesives and known surface treatments to enhance adhesion may be used. A useful approach is to employ adhesive formulations that can be cured (e.g., cross-linked or polymerized) in situ by using ultraviolet light. The benefit of such an approach is that it can save one from removing volatile solvents from an adhesive coating; but solvent-based adhesives may be employed, if desired. Aggressively tacky pressure sensitive adhesives (e.g., acrylic-based), such as the type employed on automobile licensing tags for bonding to license plates, may be used. Hot melt adhesives present another approach that avoids the need for solvent removal, and polyurethane hot melt adhesives, especially those that are moisture curable, are illustrative of those useful for uniting polyester films. Ethylene vinyl acetate adhesives can also be useful for bonding. Water-borne curable adhesives present another possible approach. Any of a variety of adhesives known to adhesive technicians may be used.

The preferred characteristics of the sheet material forming the tag 30 permit the tag to present a relatively neat appearance when affixed to a clump of agricultural produce in the supermarket display case after having been exposed to various produce processing operations. The preferred sheet material of the tag is resistant to tearing in that the tag cannot be easily torn by opposing hand forces applied at an edge of the tag. This strong resistance to tearing prevents the portions of the tag 30 encircling the twist tie from tearing and releasing the twist tie. A preferred material for providing an effective level of tear resistance is a synthetic or natural organic plastic.

The sheet material forming the tag 30 is also preferably water-resistant in that it does not disintegrate when placed in water. Ideally, exposure to water also does not cause the sheet material of the tag to exhibit significant puckering or wrinkling or other disfiguring deformation of the essentially flat nature of the tag. In fact, not only the sheet material but also the printing on it, and especially any scannable product identification matter on it, should be sufficiently water resistant to avoid disintegration or destruction when repeatedly subjected to water and washing operations. The more ideal materials for formulating the sheet material are plastic, e.g., polyolefinic thermoplastics, polyesters, as well as others. Polymers of ethylene, propylene, styrene, as well as a variety of other monomers and mixtures of monomers (e.g., to make co-polymers and ter-polymers, etc.) can be used. The polymers may be formulated so that printing is readily accepted on the surface of the sheet material or treated with special surface treatments to effect acceptance of printing. The exact structure and composition of sheet material employed in practicing the invention may vary. While economic raw materials are highly desired, it sometimes is possible to attain the benefits of economy by using somewhat more expensive raw material requiring fewer processing steps to fabricate the sheet for the tag. The result can provide an economy as great as that achieved using exceedingly economical raw material but requiring more processing.

One preferred sheet material, a polyolefin thermoplastic printable much the same as paper, is commercially available under the trademark "Teslin" from PPG Industries of Pittsburgh, Pa. Any of a variety of commercially available water-insoluble inks compatible or accepted on a sheet and retained thereon, and in any desired color, may be used to print the markings and details on the information portion 32 of the tag of the twist tie article 10. This technology is readily understood in the art. (If it should be desired to use water-soluble ink markings, a thin film of water-insoluble plastic may be applied over them to create the desired or needed water resistance.)

The character of the preferred sheet materials employed to form the tag 30 and to form the laminated ribbon layers 14, 16 of the twist tie are thus significantly different in key characteristics or properties. For the most secure and reliable banding performance, the material of the tie is easily deformed or crushed or torn by the twisting of the tie with itself, and does not readily recover its original shape after the twisting force is removed. In contrast, for superior appearance after rough handling, the material of the tag resists wrinkling or permanent deformation and especially tearing. This contradiction in optimum material characteristics is apparent in the most preferred materials for the twist tie article 10, wherein the twist tie ribbon layers 14, 16 comprise a paper material (or at least one side of the opposing ribbons comprises paper), and the sheet material of the tag 30 comprises a plastic material.

The manner of connecting the tag to the twist tie permits the tie and tag components of the twist tie article 10 to be discrete and independently formed or manufactured and may each be readily constructed of different sheet materials having the optimal characteristics for the particular component. The tie 12 and the tag 30 are subsequently brought together using the special encircling structure of the tag to form a twist tie article that can be securely and reliably banded about merchandise and can present a pleasing appearance even after harsh treatment. Another advantage of the discrete nature of the tag and tie components is the ability to easily vary other characteristics of the tie and the tag, including variations in material thickness, material surface treatments, printing and the like. Furthermore, the individual physical dimensions of the tag and the tie components may be readily varied and, as a result, may be easily mixed and matched into many different combinations of tie and tag sizes.

For example, the longitudinal length of the tie 12 may be easily varied so that a sufficient tie length is provided to circumscribe or encircle the particular size or bulk of the merchandise to be banded with the tie, with additional length provided to permit the twisting together of the tie sections and sufficient extra length to provide for effective finger gripping of the tie end sections.

The length of the tie 12 in relationship to the width of the tag 30 is such that the length of the tie is preferably more than about twice the width of the tag 30 (e.g., the tag width as measured in a direction parallel to the fold 36) to about 4 or 5 or 6 times or more the width of the tag 30. Ideally, the ratio is about 3 to 4 times.

An illustrative twist tie article 10 has a twist tie 12 component with a lateral width of about 60–70 cm (approximately one quarter of an inch) and a length of about 30 cm (approximately 12 inches). An illustrative tag component has a width of about 6–7 cm (approximately 2.5 inches), with an information portion having a length of about 6–7 cm and an attachment portion of about 1–2 cm (approximately 0.5–0.75 inches).

Figure 5:
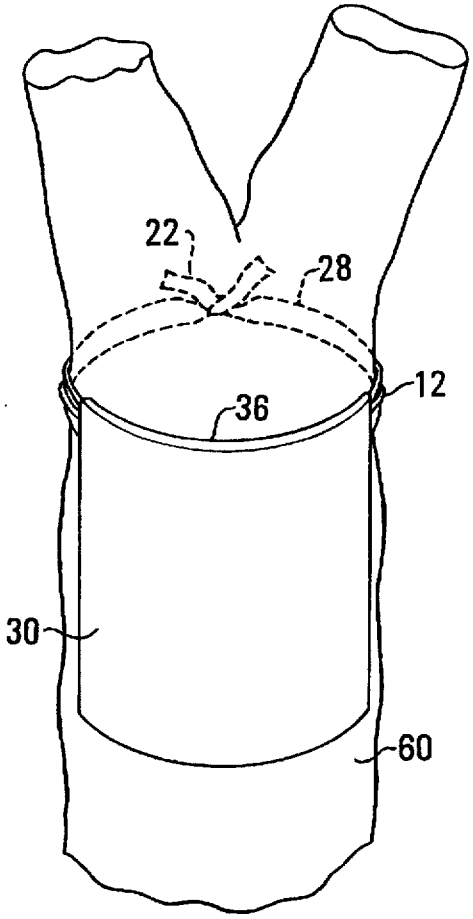
FIG. 5 is a schematic front view of an embodiment of the new twist tie article wherein the tag encircles a relatively central section of the twist tie and wherein the central section of the twist tie is illustratively shown in a banded condition about a broken away portion of the trunk or main stem of a plant.

A significant feature of the invention is the ability to easily vary the longitudinal position of the tag 30 of the twist tie 12. The independent structure of the tag and the tie (e.g., before assembly into the complete twist tie article 10) permits the tag to be wrapped about the tie at a wide variety of positions along the tie length. The position of the tag on the twist tie may be changed during manufacture of the twist tie articles, without, for example, requiring retooling operations such as the repositioning of cutting dies. The particular section 24 of the tie encircled by the tag may include an end section of the tie (e.g., wherein an end of the length of the tie is situated between the information and attachment portions—see FIGS. 1 and 4) or a relatively more central section of the tie (see FIGS. 2 and 5). A more central positioning of the tag on the twist tie permits the tag to be fixed in a relatively closely adjacent position with respect to the tie banded merchandise (even to the point of the tag being directly in contact with or abutting the merchandise). For example, the twist tie may be banded about the trunk of a plant 60 (see FIG. 5) with the tag held next to the trunk. A more endwise positioning of the tag on the tie permits the tag to be fixed in a more outstanding or projecting position from the banding section 28 of the tie and from the surface of the merchandise itself (see FIG. 1).

Optionally, one ribbon layer 14, 16 of the twist tie may be formed by a relatively less crushable or tearable material than the preferred paper material forming the other laminated layer. The optional material may comprise, for example, a plastic. However, the secureness and reliability of the twisted condition of such a twist tie may be less than that of ties having both layers comprised of a paper material.

Those skilled in the art will readily recognize that this invention may be embodied in still other specific forms than illustrated without departing from the spirit or essential characteristics of it. The illustrated embodiment is therefore to be considered illustrative and not restrictive, the scope of the invention being indicated by the appended claims rather than the foregoing description; and all variations that come within the meaning and range of equivalency of the claims are intended to be embraced thereby.

That which is claimed is:

1. A twist tie article permitting simultaneous banding and tagging of merchandise, comprising:

an elongate twist tie for banding about merchandise and having a deadfold wire and opposing flat ribbon layers that have inward faces bonded together to form a laminate having substantially flat parallel exterior surfaces with said deadfold wire embedded between said flat ribbon layers, and a tag comprising a single continuous panel of water resistant sheet material discrete from said twist tie, said tag having an information portion and an attachment portion and a fold forming a boundary therebetween, said information and attachment portions extending in the same direction from said fold, the extent of said information portion away from said fold being greater than the extent of said attachment portion away from said fold such that at least a part of both surfaces of the sheet material of said information portion is viewable for displaying printed matter thereon, said twist tie having a section thereof situated between said information and attachment portions proximate to said fold, said information and attachment portions being directly bonded to each other with said twist tie being situated between said fold and said bond joining said portions, whereby the sheet material of said tag is wrapped entirely about said twist tie to directly bond to itself to provide a secure and reliable attachment of said tag about said twist tie without need for relying upon a bond between said tag and said twist tie, said information and attachment portions being in substantial flat parallel relationship over said opposing flat ribbon layers of said twist tie to thereby provide exterior flattened parallel surfaces comparable to said flat parallel exterior surfaces of said twist tie.

2. The twist tie article of claim 1 wherein the sheet material of said tag is tear resistant.

3. The twist tie article of claim 1 wherein the sheet material of said tag comprises a plastic.

4. The twist tie article of claim 1 wherein at least one layer of said twist tie comprises a paper material.

5. The twist tie article of claim 1 wherein the opposing laminated layers lack distortion memory such that securing a band of said twist tie about merchandise is readily accomplished by twisting a section of said twist tie with another section of said twist tie using only an 180 degree hand rotation motion applied to the sections of said twist tie.

6. The twist tie article of claim 5 wherein at least one layer of said twist tie comprises paper material.

7. The twist tie article of claim 5 wherein at least one layer of said twist tie comprises a material easily torn upon twisting a section of said twist tie with another section of said twist tie.

8. The twist tie article of claim 1 wherein the sheet material of said tag differs from the material forming at least one layer of said twist tie.

9. The twist tie article of claim 1 wherein the extent of said information portion from said fold is more than about twice the extent of said attachment portion from said fold.

10. The twist tie article of claim 1 wherein the bond between said information and attachment portions lies in a strip having a width less than twice the width of the section of said twist tie situated between said information and attachment portions.

11. The twist tie article of claim 1 wherein said information portion includes printed matter comprising a scannable merchandise marking and wherein said printed matter is water resistant.

12. The twist tie article of claim 1 additionally comprising a bond between said tag and said twist tie to enhance resistance of movement of said tag along the length of said twist tie.

13. The twist tie article of claim 1 wherein the section of said twist tie situated between said information and attachment portions of said tag includes an end of a length of said twist tie.

14. The twist tie article of claim 1 where said bond is formed by an adhesive.

* * * * *